US008132587B2

(12) United States Patent
Roche

(10) Patent No.: US 8,132,587 B2
(45) Date of Patent: Mar. 13, 2012

(54) APPARATUS AND METHOD FOR INTRODUCING AIR INTO A HYDROPNEUMATIC RESERVOIR

(75) Inventor: Emile Roche, Bourg-en-Bresse (FR)

(73) Assignee: Charlatte Reservoirs, Migennes (FR)

( * ) Notice: Subject to any disclaimer, the term of this patent is extended or adjusted under 35 U.S.C. 154(b) by 487 days.

(21) Appl. No.: 12/422,585

(22) Filed: Apr. 13, 2009

(65) Prior Publication Data

US 2009/0255595 A1 Oct. 15, 2009

(30) Foreign Application Priority Data

Apr. 14, 2008 (FR) ..... 08 02040

(51) Int. Cl.
*E03B 5/00* (2006.01)

(52) U.S. Cl. ..... 137/14; 137/624.11; 137/565.11; 137/565.15

(58) Field of Classification Search ..... 137/624.11, 137/565.15, 565.11, 565.01, 12, 14
See application file for complete search history.

(56) References Cited

U.S. PATENT DOCUMENTS 3,225,696 A * 12/1965 Brigman ..... 137/211
3,630,225 A * 12/1971 Chitel ..... 137/565.15
5,647,392 A 7/1997 Roche
5,868,280 A * 2/1999 Schroeder ..... 137/209
6,047,721 A 4/2000 Roche

FOREIGN PATENT DOCUMENTS

| | | |
|---|---|---|
| EP | 0 003 700 | 8/1979 |
| EP | 0 617 227 | 9/1994 |
| EP | 0 895 020 | 2/1999 |
| FR | 2 416 417 | 8/1979 |
| WO | 97/12171 | 4/1997 |

OTHER PUBLICATIONS

French Search Report dated Sep. 15, 2008, from corresponding French application.

* cited by examiner

*Primary Examiner* — Kevin Lee
(74) *Attorney, Agent, or Firm* — Young & Thompson

(57) ABSTRACT

Apparatus for introducing air (3) into a hydropneumatic reservoir (1) connected to pipework (2) comprising a sensor (6) of the pressure in the reservoir, a valve (9) controlled by a signal from the sensor and opening into the open air on one side, a tube (8) connected at one end to the valve and at the opposite end to the pipework (2), a first check valve (11) arranged in the tube to prevent liquid from travelling towards the open air, and a second check valve (5) arranged in the pipework between the reservoir (1) and the tube (8), the second check valve (5) being in the closed state when the pressure in the pipework (2) on the side nearest the tube (8) is less than the pressure in the reservoir (1).

13 Claims, 2 Drawing Sheets

APPARATUS AND METHOD FOR INTRODUCING AIR INTO A HYDROPNEUMATIC RESERVOIR

CROSS-REFERENCE TO RELATED APPLICATIONS

The instant Application claims priority to French Application 0802040, filed Apr. 14, 2008.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

The present invention relates to the field of apparatus for introducing air into a hydropneumatic reservoir or network provided in hydraulic pipework, notably in a network for discharging waste water or chemical liquids.

(2) Description of Related Art

A hydropneumatic reservoir may be used as an anti-pressure surge reservoir of a hydraulic pipework or network in order to compensate the effects of underpressure and overpressure produced for example by stoppage of a pump or the closure of a valve. The operation of such a reservoir is known in particular from the document FR 2416417. In such a reservoir, the pressurised water or liquid located at the lower end is surmounted by air or gas, which is also pressurised, the quantity of which has to remain substantially constant to ensure correct operation of the apparatus. In fact, if there is a lack of air, the pipework is inadequately protected, and if there is too much air there is a risk of air escaping into the pipework, which must be prevented.

The publication EP 0617227 describes a system for regulating air for a hydropneumatic reservoir comprising an air introduction chamber which can be evacuated by means of an evacuating solenoid valve. A solenoid valve for taking air into the chamber is opened. Then the two first solenoid valves are closed and a solenoid filling valve is opened in order to drive air towards the reservoir. The solenoid valves are controlled by control means connected to a detector which emits a signal in the event that the water level becomes higher than the level of the detector. This system requires an electricity supply, which may prove expensive in zones remote from the electricity grid, and causes the escape of a certain amount of liquid, which is not really desirable in the case of drinking water and should obviously be prevented in the case of other liquids.

In the field of pumping water, even contaminated waste water, the dissolution of air in the water is greater than the release of gases. It is therefore important to compensate an air deficit.

The publication EP 0895020 describes an air introduction apparatus for a hydropneumatic reservoir in which the air is introduced into a low pressure zone, such as the zone upstream of a pump, by opening a solenoid valve. The losses of liquid are prevented but an electricity supply is needed and the introduction of air is controlled by means of liquid level sensors in contact with the liquid, so that operation may be disrupted by deposits when contaminated water is being pumped.

The present invention sets out to overcome these disadvantages.

BRIEF SUMMARY OF THE INVENTION

The present invention sets out to improve the introduction of air into a hydropneumatic reservoir.

The present invention aims to allow the introduction of a suitable quantity of air as and when required.

The apparatus for introducing air into a hydropneumatic reservoir thus comprises a detector of the pressure in the hydropneumatic reservoir, a valve controlled by a signal from the sensor and opening into the open air on one side, a tube connected at one end to the valve and at the opposite end to pipework connected to the reservoir. A first check valve is arranged in the tube to prevent liquid from passing along the tube towards the valve and a second check valve is arranged in the pipework between the reservoir and the tube. The second check valve is closed when a pump mounted on the pipework is stopped and open when the pump is started up and in operation. Consequently there is a mechanical introduction of air which is triggered when the air pressure in the reservoir becomes too low. There is no longer any need for an electricity supply.

The pipework may consist of large diameter pipes, for example between 100 and 2500 mm, which are protected from pressure surges by the hydropneumatic reservoir. The tube may have a small diameter, of the order of a few tens of millimeters, for example 5 to 40 mm.

In one embodiment, the pipework opens into the reservoir at an altitude above that at which the tube opens into the pipework. This therefore promotes the migration of the air introduced through the tube into the pipework towards the reservoir.

In one embodiment, the apparatus comprises an air trap. The air trap enables the air introduced into the pipework to be directed towards the reservoir.

In one embodiment, the sensor comprises regulating masses. Thus, during operation, it is possible to carry out fine adjustment adapted to the actual characteristics of the liquid network which always differ to some extent from the nominal characteristics.

In one embodiment, the sensor comprises at least one elastic regulating element, for example a spring.

In one embodiment, the sensor comprises a piston and a cylinder, one of which is fixed while the other is movable. A control member for the valve may be connected to the movable part. The connection may be provided directly, via a lever, for example an articulated lever arm.

In one embodiment, the sensor is connected to the valve by a lever arm. The lever arm may be graduated. Regulating masses may be arranged on the arm. In this way it is possible to provide regulation in a similar manner to the use of lever scales.

In an alternative embodiment the valve is electrically actuatable. The apparatus comprises an electrical connection to the sensor.

The apparatus may comprise regulation of the period of opening of the valve. Regulation may be carried out on the pressure sensor or connected to the pressure sensor.

In one embodiment the apparatus comprises an actuating member timed to act between the opening and closing of the valve.

Advantageously, the sensor comprises bellows arranged between a solid plate and a perforated plate. The perforated plate may open into the reservoir. A chamber may be defined between the bellows, the solid plate and the perforated plate. The solid plate may be arranged in the upper position and the perforated plate in the lower position, the valve taking the form of a seal arranged on an upper surface of the solid plate. The seal may come into contact with an opening of the tube.

When the pressure in the chamber of the sensor equal to the pressure in the gas-filled part of the hydropneumatic reservoir is high enough, the seal closes off the end of the tube. When this pressure falls below a selected pressure threshold, which may be modified by adjustment, the solid plate falls away, taking with it the seal which then opens up the opening of the tube through which the air can circulate. If the liquid pressure in the pipework is sufficient the first check valve arranged on the tube remains closed. If the pressure in the pipework decreases, this check valve opens, and the air from the atmosphere circulates in the tube, passing through the check valve. A certain volume of air then passes back into the pipework. Then, when the pressure in the pipework increases once more, for example when a pump is started up, the first check valve closes. The air is driven out by the liquid in the pipework towards the reservoir and enters the hydropneumatic reservoir and is then compressed to the pressure prevailing in the gas part of the hydropneumatic reservoir, i.e. the upper part.

Air is thus introduced into the hydropneumatic reservoir.

If the quantity of air introduced is still too low, the phases described above start again, allowing new air to be introduced. On the other hand, if the pressure in the hydropneumatic reservoir is still sufficient, the valve remains closed, irrespective of the position of the first check valve. The second check valve makes it possible to maintain operational pressure on the hydropneumatic reservoir side. The second check valve closes when the pump stops and opens when the pump starts up or more generally when there is a resumption of the circulation of liquid in the pipework. The air introduced into the pipework upstream of the second check valve then passes through the second check valve and is displaced by the movement of the liquid towards the hydropneumatic reservoir.

In one embodiment, the reservoir comprises an inner tube extending downwardly from one end of the reservoir. The sensor is located in the tube.

The invention also relates to a hydropneumatic system for air recharging comprising a hydropneumatic reservoir, pipework connected to the reservoir and an air introduction device as described above.

The system may comprise a pump for circulating liquid in the pipework. The second check valve is closed when the pump is stopped and opens as soon as the pump starts up and as long as it is in operation.

Advantageously, the pipework going from the pump to the reservoir runs constantly uphill.

The process for introducing air into a hydropneumatic reservoir connected to a pipework provided with a pump comprises steps for detecting the pressure in the reservoir by means of a sensor, opening a valve controlled by the sensor in the event of insufficient pressure in the reservoir, the pump being stopped and a check valve in the pipework being closed; when the valve is opened, the atmospheric pressure is triggered in the tube, causing the pipework to be emptied; when the pump starts up again, a check valve arranged in the tube closes under pressure and prevents the liquid from rising back up into the tube, while the air introduced into the pipework is displaced into the reservoir and the check valve in the pipework opens.

In this way air is introduced by mechanical means. There is no need for an electricity supply, which makes it particularly economical.

BRIEF DESCRIPTION OF THE SEVERAL VIEWS OF THE DRAWINGS

The present invention will be better understood from a study of the detailed description of some embodiments by way of example which are in no way restrictive, as illustrated in the attached drawings, wherein.

DETAILED DESCRIPTION OF THE INVENTION

Figure 1:
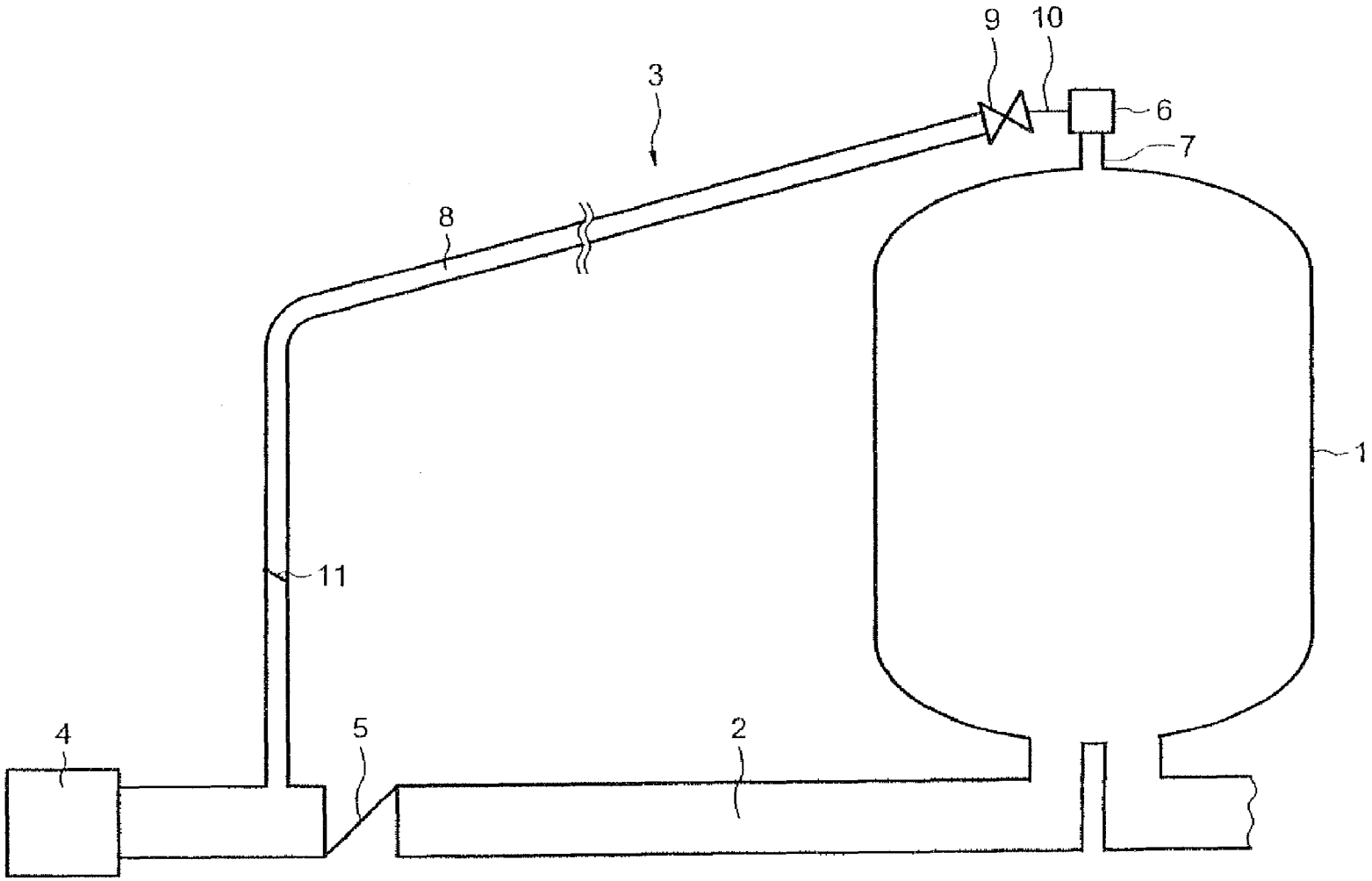
FIG. 1 is a schematic view of a hydraulic system comprising an air introduction apparatus and FIG. 2 is a schematic view of a hydraulic system comprising a different air introduction apparatus.

As can be seen from FIG. 1, the air introduction apparatus is intended for a hydropneumatic reservoir 1 in the form of a flask, a lower part 1*b* of which is connected to hydraulic pipework 2. The lower part 1*b* of the hydropneumatic reservoir 1 is generally filled with liquid, particularly water, and an upper part 1*a* of the hydropneumatic reservoir 1 is generally filled with gas, particularly air. The quantity of gas present in the upper part 1*a* of the hydropneumatic reservoir 1 must be between a lower limit and an upper limit as a function of the dimensions of the hydropneumatic reservoir 1, the pipework and the operating pressures provided. In the case of a deficiency of gas, the hydropneumatic reservoir 1 does not suitably protect the hydraulic system against pressure surges. Moreover, there is a risk that the hydropneumatic reservoir 1 will not be properly drained, thus preventing it from performing its functions. If there is an excessive quantity of gas present, during emptying of the hydropneumatic reservoir 1, there is a risk of the gas being conveyed into the pipework.

Exchanges also take place between the gas and the liquid, sometimes by degassing of the liquid and most often by the dissolving of gas in the liquid. To remedy this, an air introduction apparatus is installed upstream of the reservoir 1 in the pipework 2 and downstream of a supply pump 4 immersed in a water container which may be a well, a borehole or a tank. A retaining valve 5 is associated with the feed pump. The valve 5 is installed in the pipework 2 between the pump 4 and the reservoir 1. The valve 5 prevents water from returning from the reservoir 1 to the pump. The air introduction apparatus 3 comprises a pressure sensor 6 mounted on the reservoir 1 for detecting the pressures inside said reservoir 1. The pressure sensor 6 is mounted on the upper part 1*a* of the reservoir 1, preferably at the top. The pressure sensor 6 may take the form of a pressure switch.

The pressure sensor 6 may be connected to the upper part 1*a* of the reservoir 1 by a duct section 7 for the purpose of arranging the pressure sensor 6 above the reservoir 1, thus reducing the risk of liquid backing up in the pressure sensor 6.

The air introduction apparatus 3 comprises a tube 8 which is small in diameter by comparison with the diameter of the hydraulic pipework 2. The tube 8 is connected to one end of the hydraulic pipework 2 upstream of the valve 5, for example at a short distance from said valve 5. The opposite end of the tube 8 is connected to a valve 9 which enables the tube 8 to be connected to the outer atmosphere. The valve 9 may be of the mechanical or electromechanical type. The valve 9 is controlled by a signal coming from the pressure sensor 6 via an actuating member 10 of a mechanical type. In other words, the pressure sensor 6 generates a mechanical signal transmitted by the mechanical actuating member 10 to the mechanically controlled valve 9. The air introduction apparatus 3 also comprises a check valve 11 arranged in the tube 8, for example close to the junction between the tube 8 and the hydraulic pipework 2.

The check valve 11 is provided to allow air from the valve 9 to enter the hydraulic pipework 2 via the tube 8. The check valve 11 prevents liquid and gas escaping when the pressure in the part of the hydraulic pipework 2 upstream of the valve 5 is greater than atmospheric pressure.

In other words, if the valve 9 is closed, air is prevented from entering the hydraulic pipework 2. When the valve 9 is open, air is introduced if the pressure in the hydraulic pipework 2 upstream of the valve 5 is lower than atmospheric pressure.

Moreover, the valve 5 is open while fluid is circulating towards the reservoir 1, notably during pumping. The valve 5 closes and remains closed when the upstream pressure becomes less and remains less than the pressure downstream of the valve 5, which is substantially equal, apart from loss of charge, to the pressure in the reservoir 1.

After air has been introduced into the pipework 2 upstream of the valve 5, the check valve 11 closes when the pressure upstream of the valve 5 becomes greater than atmospheric pressure and the valve 9 closes on the command of the actuating member 10 dependent on the pressure in the reservoir 1 detected by the pressure sensor 6. When the pressure upstream of the valve 5 becomes greater than the pressure in the hydropneumatic reservoir 1, the valve 5 opens and the air present upstream of said valve 5 travels downstream and reaches the reservoir 1, to be stored in the upper part 1*a* thereof. In this way the quantity of air present in the reservoir 1 is increased.

Generally, the valve 5 is arranged at an altitude which is below that of the lower part 1*b* of the reservoir 1, so that the introduction of air cannot take place directly when the upstream and downstream pressures, relative to the valve 5 in the pipework 2, are less than atmospheric pressure.

The pressure sensor 6 may take the form of a pressure switch located at the top of the reservoir. In this embodiment, the sensor is at a distance from the liquid, unlike other detection means such as oscillating electrical floats, electrodes, etc., which are not particularly reliable because they are subject to soiling or deposits.

The sensor 6 opens the valve 9 if the pressure during emptying of the reservoir reaches a regulated minimum pressure P corresponding to an air deficit. Stoppage of the pump 4 causes the reservoir to be emptied, in which case the liquid that it contains flows in the downstream direction of the pipework 2 and the valve 5 is closed by the pressure exerted by the liquid from the reservoir. When the pump starts up again, the valve 5 opens under the thrust of the pumped water (and possibly air), allowing the flow to take place in the downstream direction, i.e. into the reservoir and pipework 2.

The introduction of air takes place without the need for the installation of a compressor.

To facilitate the draining of water into the pumping tank and then the entry of the air thus introduced in its place into the reservoir, the pipework 2 running from the pump 4 to the reservoir 1 preferably runs constantly uphill.

Figure 2:
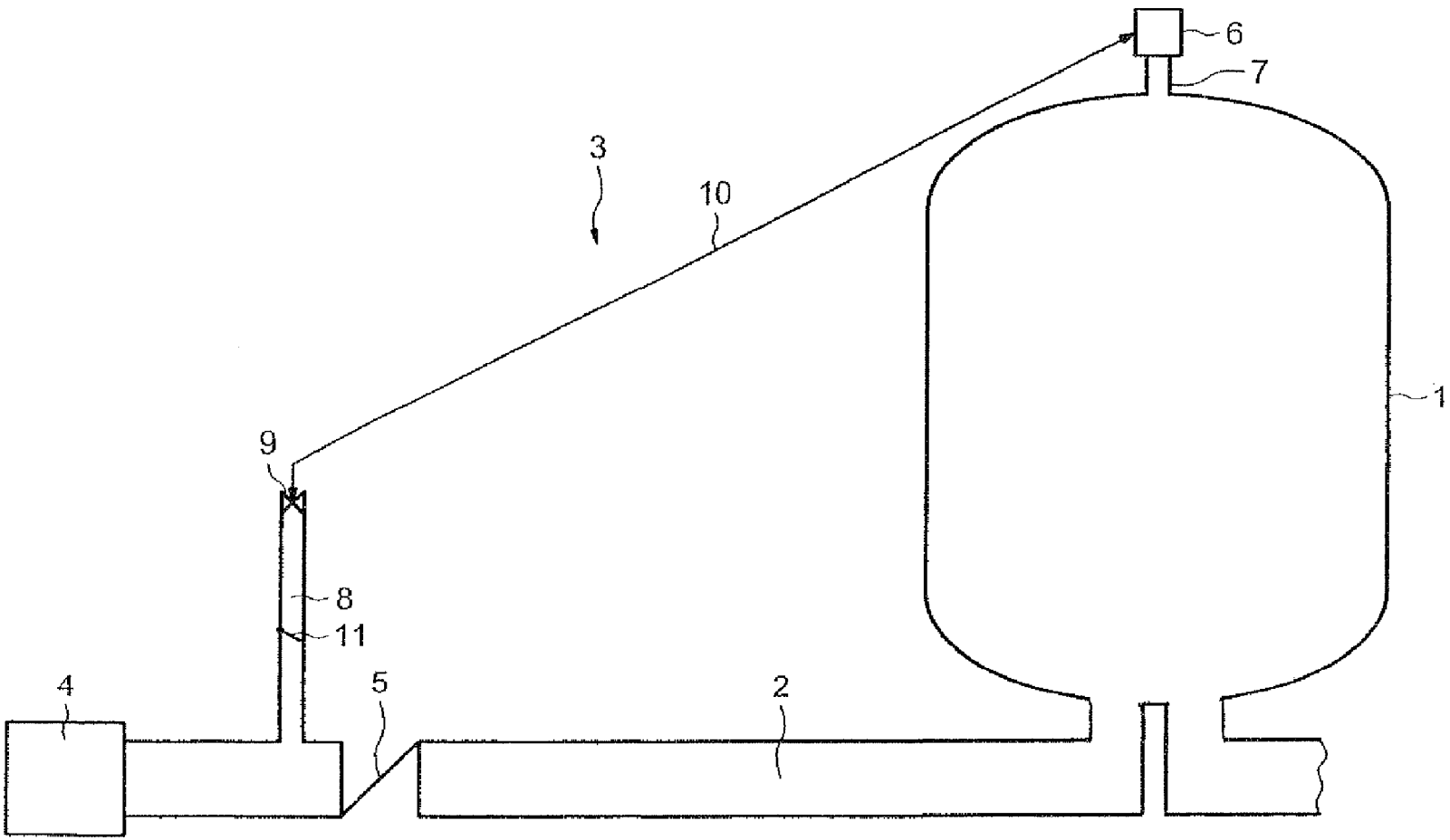

In the embodiment shown in FIG. 2, the tube 8 is short in length, for example a few dozen centimeters long, and may be a substantially vertical portion directed upwardly from the hydraulic pipework 2. The valve 9 may be of the solenoid type and is controlled by the electrical actuating member 10 forming a control interface between the pressure sensor 6 and the solenoid valve 9. The pressure sensor 6 is thus configured to generate an electrical signal which is transmitted to the solenoid valve 9, if necessary after processing carried out by the actuating member 10. This embodiment requires an electrical connection and consequently an electricity supply which may sometimes be provided by a solar panel and a storage battery. This embodiment is particularly suitable in cases where the distance between the reservoir 1 and the valve 5 is relatively great.

The distance between the sensor 6 and the tube 8 may be fairly long as the connection between them is purely electrical. If necessary a timer could be provided for the purpose of regulating the period of opening of the solenoid valve as required or extending it beyond the maximum pressure of the first filling of the reservoir after it has been emptied for the first time.

In the case of the embodiment shown in FIG. 2, the pressure sensor 6 or pressure switch controls the opening of the valve at the pressure Pmini and closure at a higher pressure. In this way it is possible to govern the opening time and increase the operating precision. Finally, if it is not desirable to have a moment of closure of the solenoid valve beyond the maximum pressure peak, it is possible for the solenoid valve to be closed by the pressure switch at a pressure less than or equal to the maximum pressure. Moreover, the actuating member 10 may comprise a timer that cuts in when the solenoid valve 9 is opened and causes the solenoid valve to close at a moment selected as a function of the time which has passed since the moment of closure. Thus, after calibration, an excellent level of precision is obtained with regard to the quantity of air introduced.

In order to start up the operation of the reservoir it is possible to provide a pre-inflation step by arranging temporary water level sensors, for example in the form of a transparent vertical tube fixed to two valves provided in the wall of the reservoir, one in the air zone and the other in the water zone. The two valves are open and compressed air is injected through one of them until the level of the air/water surface corresponds to the desired value, either static operation with the pipework 2 full and the pump stopped or a permanent pumping operation. The tube can then be removed at the end of the operation after the valves have been shut. Thus it is particularly simple to start up the hydropneumatic reservoir. The operation of the air introduction apparatus may be the subject of fine adjustment on site, during the starting up of the installation.

The air introduction apparatus may be installed in hydraulic systems for waste water or clean water. In the case of the pumping of clean water, with pumps without a foot valve, the tube element 8 is provided with its check valve 11 but without the solenoid valve 9. A solenoid valve is then connected directly to the pipework 2 close to the pump. It opens and closes in the same way as the solenoid valve 9 mentioned previously in the description.

It is open and carrying the water draining away when the pump is stopped and an air deficit is found. It closes again as soon as the pump starts up.

This embodiment is highly suitable for installations with frequent stopping and starting, notably for displacing waste water. The embodiment with timed closing of the valve is particularly suitable for installations having a substantial volume of pipework 2 between the check valve and the water level in the pumping tank and wherein the intervals between stopping and starting are such that they allow total emptying, if necessary, of this upstream part of the pipework 2.

In other words, during the emptying of the anti-pressure surge reservoir, air deficits are detected using a pressure sensor 6 (which may take the form of a pressure switch) located at the top of the reservoir.

The stoppage of the pump 4 causes emptying of the reservoir, while the liquid which it contains then flows downstream through the pipework 2 and the valve 5 is closed by the pressure exerted by the liquid draining out of the reservoir. Very generally, in installations for pumping waste water, the pumps are submerged in a tank and do not have a foot valve, with the result that when pumping stops and if the valve 9 is open the tube 8 allows atmospheric pressure to prevail throughout this tube and the small valve 11 then opens. Thus the pipework section 2 located upstream of the valve 5 may start to empty into the pumping tank, through the pump 4.

This emptying of the pipework 2 persists as long as:

the valve 9 is not closed again by the sensor 6 or a timer. In this way it is possible to regulate the emptying time and hence the volume thereof.

or as long as the pump 4 does not start up again.

The starting up of the pump, on the one hand, causes the valve 11 to close, thus preventing liquid from backing up in the tube 8 and, on the other hand, allows air to be introduced which has taken the place of the liquid drained into the pipework 2 located upstream of the valve 5 which is now open. This air is forced back and enters the reservoir which is equipped at its base with an air trap 12 (other types of traps are possible), thus partially or totally making up the deficit found. If this intake of air is not sufficient, the operation is repeated next time the pump stops. Thus, air is introduced without the need for a compressor to be installed.

Moreover, the system using a sensor detecting a minimum pressure, regulated at the end of the drainage of the reservoir, is reliable compared with the detection of a deficit of air in permanent pumping operation using an electrical level: bulbs, electrodes or probes which are not in contact with the water. In fact, if the pressure in the reservoir at the end of the first filling after emptying is higher than the pressure in permanent pumping operation, this electrical detection will wrongly interpret it as an air deficit.

The invention also applies to regulating reservoirs. It is sufficient to equip the reservoirs with conventional pressure switches, not in contact with the liquid, scaled to the stop and start pressures of the pumps, to install an electronic liquid level detector which acts if, on the stoppage of a pump controlled by its pressure switch, the liquid level is above the normal value, corresponding to an air deficit. This detector may be a clear water electrode or, more preferably as there is no contact with the liquid, it may be of the type using ultrasound, radar, magnetic location or weighing of the reservoir plus liquid contained therein, etc.

The detector will then deliver a signal to the electric valve 9 which opens and closes as in the case of the anti-pressure surge reservoir.

The invention claimed is:

1. An apparatus for introducing air into a hydropneumatic reservoir, comprising:

a sensor of the pressure in the reservoir;

a valve controlled by a signal from the sensor and opening into the open air on one side;

a tube connected at one end to the valve and at another end to pipework connected to the reservoir;

a first check valve arranged in the tube to prevent liquid from passing through the tube towards the valve; and a second check valve arranged in the pipework between the hydropneumatic reservoir and the tube, the second check valve being closed when a pump mounted on the pipework is stopped and open as soon as the pump starts up.

2. The apparatus according to claim 1, wherein the pipework opens into the hydropneumatic reservoir at an altitude above that at which the tube opens into the pipework.

3. The apparatus according to claim 1, wherein the valve is electrically actuatable and comprises an electrical connection to the sensor.

4. The apparatus according to claim 1, comprising a system for regulating the period of opening of the valve.

5. The apparatus according to claim 4, wherein the regulating system is connected to the sensor.

6. The apparatus according to claim 4, wherein the regulating system comprises a timer.

7. The system according to claim 1, wherein the signal coming from the sensor is mechanical.

8. The apparatus according to claim 2, wherein the valve is electrically actuatable and comprises an electrical connection to the sensor.

9. The apparatus according to claim 2, comprising a system for regulating the period of opening of the valve.

10. The apparatus according to claim 3, comprising a system for regulating the period of opening of the valve.

11. A hydropneumatic air recharging system, comprising an anti-pressure surge hydropneumatic reservoir, pipework connected to the hydropneumatic reservoir and an apparatus according to claim 1.

12. The apparatus according to claim 11, wherein the pipework running from the pump to the hydropneumatic reservoir runs constantly uphill.

13. A method of introducing air into an anti-pressure surge or regulating a hydropneumatic reservoir connected to pipework provided with a pump, comprising the steps of:

detecting the pressure in the hydropneumatic reservoir by means of a sensor;

opening a valve controlled by the sensor in the event of insufficient pressure in the hydropneumatic reservoir, the pump being stopped and a check valve in the pipework being closed; and the valve being open, atmospheric pressure prevails in a tube, thus causing the pipework to be emptied and filled with air.

* * * * *